US005338467A

United States Patent [19]

Olson et al.

[11] Patent Number: 5,338,467

[45] Date of Patent: Aug. 16, 1994

[54] SULFONATE GREASE IMPROVEMENT

[75] Inventors: William D. Olson, Scarborough; Ronald J. Muir; Theo I. Eliades, both of West Hill, all of Canada

[73] Assignee: Witco Corporation, New York, N.Y.

[21] Appl. No.: 25,867

[22] Filed: Mar. 3, 1993

[51] Int. Cl.[5] ..... C10M 115/10; C10M 113/00

[52] U.S. Cl. ..... 252/33.4; 252/18

[58] Field of Search ..... 252/33.4, 18

[56] References Cited

U.S. PATENT DOCUMENTS 3,816,310 6/1974 Hunt ..... 252/33.4
4,560,489 12/1985 Muir et al. ..... 252/33.4
4,597,880 6/1986 Eliades ..... 252/33.4
4,744,920 5/1988 Fischer et al. ..... 252/18
4,824,584 4/1989 Muir et al. ..... 252/32

*Primary Examiner*—Ellen M. McAvoy
*Attorney, Agent, or Firm*—Lockwood, Alex, FitzGibbon & Cummings

[57] ABSTRACT

The process of forming a non-Newtonian oil composition in the form of a grease comprising an overbased calcium sulfonate and solid particles of colloidally dispersed calcium carbonate in the form of calcite which comprises heating overbased calcium sulfonate, amorphous calcium carbonate and a converting agent comprising a fatty acid of twelve to twenty-four carbon atoms in an oleaginous medium.

9 Claims, No Drawings

SULFONATE GREASE IMPROVEMENT

This invention relates to high performance overbased calcium sulfonate greases, the preparation of these greases and intermediates. More particularly this invention relates to a process of forming a non-Newtonian oil composition in the form of a grease comprising an overbased calcium sulfonate and solid particles of colloidally dispersed calcium carbonate in the form of calcite which comprises heating overbased calcium sulfonate, amorphous calcium carbonate and a converting agent comprising a fatty acid of twelve to twenty-four carbon atoms in an oleaginous vehicle.

As pointed out in commonly assigned U.S. Pat. No. 4,560,489 of Muir at column 1, lines 28 to 46, Non Newtonian greases or grease like overbased calcium sulfonate compositions have corrosion-inhibiting properties and have utility for a variety of uses such as, for instance, in automobile and truck body undercoating, and for various other purposes known to the art and are disclosed in various publications and patents, such as U.S. Pat. Nos. 3,242,079; 3,372,115; 3,376,222; 3,377,283; 3,523,898; 3,661,622; 3,671,012; 3,746,643; 3,730,895; 3,816,310; and 3,492,231. Such greases or grease-like compositions have gone into wide spread use either as such, or mixed with other ingredients to produce compositions for use in a variety of environments and generally speaking they are characterized by reasonably good E.P. & Antiwear Properties, high dropping points, reasonably good resistance to mechanical breakdown, salt spray and water-corrosion resistance, thermal stability at high temperatures, and other desirable properties.

As is well known greases are sold in various grades depending upon the softness of the grease. The softer the grease the more fluid the grease. Typically these greases are rated or graded on the basis of their worked cone penetration range. For example, greases sold under the designation grade zero have a cone penetration number from about 355 to 385, those having a cone penetration range of 310 to 340 are designated grade one and the most widely sold greases have a cone penetration range of 265 to 295 and are designated grade two. The lower the grade of the grease the more relatively inexpensive oleaginous vehicle and the cheaper the grease.

For the purposes of this invention cone penetration is measured by the ASTM cone penetration test (D217). Penetration is the depth, in tenths of millimeters, to which a standard cone sinks into the grease under prescribed conditions. Thus higher penetration numbers indicate softer greases, since the cone has sunk deeper into the sample.

While the greases described in U.S. Pat. No. 4,560,489 have excellent properties and routinely have worked pen numbers of 265 to 295, the particularly preferred greases contain about 40 to 45% by weight overbased calcium sulfonate (See column 7, lines 54–61). At column 12, lines 52 et seq., the patentees point out that if the content of overbased calcium sulfonate is in the range of 38% by weight or less, a relatively soft grease is obtained which, generally is not optimum i.e. the grease does not satisfy requirements for grade two. A firmer grease is obtained at 41 to 45% by weight overbased calcium sulfonate. Since overbased calcium sulfonate is the most expensive component of these greases it is desirable to reduce the overbased calcium sulfonate content and replace same with relatively inexpensive oleaginous media without lowering the grease grade.

The greases disclosed in U.S. Pat. No. 4,560,489 can be prepared by one step or two step processes. In the one step process, neutral calcium sulfonate, hydrated lime, lubricating oil, a converting agent capable of converting amorphous calcium carbonate into crystalline calcium carbonate, a catalyst suitable for promoting carbonation of the neutral calcium sulfonate, such as methanol, are carbonated to form a non-Newtonian highly overbased calcium sulfonate solution. Additional oil stock, lime, water, boric acid and fatty acid are then added to complete the production of the overbased calcium sulfonate grease. In the two step process, a composition comprising a Newtonian highly overbased calcium sulfonate solution is first converted to a thickened intermediate non-Newtonian product by initial treatment thereof with a converting agent such as acetic acid, propionic acid or an alcohol. Then, there is subsequently added thereto, at elevated temperatures, boric acid admixture with or dissolved or partially dissolved in hot water, lime or calcium hydroxide and the soap-forming aliphatic monocarboxylic or fatty acid such as a $C_{12}$ to $C_{24}$ acid. In both the one step and two step processes, the soap-forming aliphatic monocarboxylic acid or fatty acid containing from 12 to 24 carbon atoms is added to the non-Newtonian highly overbased calcium sulfonate solution containing calcium carbonate in the calcite form.

The general object of this invention is to provide high performance overbased calcium sulfonate greases having a relatively low concentration of overbased calcium sulfonate for each grade level of the grease.

Another object of this invention is to provide a method of producing overbased calcium sulfonate greases having a relatively low concentration of overbased calcium sulfonate.

In one aspect this invention is a Newtonian composition comprising overbased calcium sulfonate, amorphous calcium carbonate, a fatty acid of twelve to twenty-four carbon atoms and an oleaginous media.

In a second aspect this invention comprises forming a non-Newtonian composition in the form of a grease comprising an overbased sulfonate, colloidally dispersed calcium carbonate in the form of crystalline solids of calcite which comprises heating a Newtonian composition comprising overbased calcium sulfonate, amorphous calcium carbonate, an oleaginous vehicle and a converting agent comprising a fatty acid of 12 to 24 carbon atoms.

The general object of this invention can be attained by a process of forming a non-Newtonian oil composition in the form of a grease comprising an overbased calcium sulfonate, colloidally dispersed calcium carbonate in the form of calcite which comprises heating a composition comprising overbased calcium sulfonate, amorphous calcium carbonate, an oleaginous vehicle and a converting agent comprising a fatty acid of 12 to 24 carbon atoms. The full properties of the grease are then developed by boration. Surprisingly, we have found that by employing a fatty acid of 12 to 24 carbon atoms as at least a portion of the converting agent, it is possible to produce grade two greases containing about 32% by weight or less starting overbased calcium sulfonate whereas, other things being equal, prior to this invention it required about 40 to 45 weight percent overbased calcium sulfonate to produce a grade two grease.

Briefly the greases of this invention can be formed by heating overbased calcium sulfonate, amorphous calcium carbonate and a converting agent comprising a fatty acid of 12 to 24 carbon atoms in an oleaginous media to convert the amorphous calcium carbonate to calcite crystals and adding boric acid compound thereto and forming a calcium borate in situ.

Suitable sulfonic acids useful in the production of the calcium sulfonates are oil-soluble and can be produced by sulfonating a feedstock which is most commonly a linear or branched chain alkyl benzene such as a mixture of mono-and di-alkyl benzenes in which the alkyl radical contains largely from 12 to 40 carbon atoms, generally mixtures of such alkyl radicals. The sulfonic acids are generally produced in solution in a volatile inert organic solvent such as Varsol or naphtha or mineral spirits and are conventionally converted to calcium sulfonates by reaction with calcium hydroxide. In the practice of our present invention, as indicated above, it is particularly advantageous to utilize alkyl benzene sulfonic acids containing from 12 to 40 carbon atoms or mixtures containing primarily 12 to 40 carbon atoms as the alkyl radical(s). However, in the broader aspects of our invention, generally equivalent oil-soluble sulfonic acids can be used, such as are shown, for instance, in U.S. Pat. Nos. 3,242,079; 3,671,012; and others of the patents referred to above.

The overbased calcium sulfonates useful in this invention can be prepared by any of the techniques employed in this art. Typically, these materials can be prepared by heating neutral calcium sulfonate or sulfonic acids, oleaginous vehicle, hydrated lime and a carbonation promoter, such as methanol, to the carbonation temperature and adding sufficient carbon dioxide to produce an overbased sulfonate having the desired TBN. For purposes of this invention, the overbased calcium sulfonate can have a metal ratio of about 6 to 35.

Soap forming aliphatic or fatty acids of 12 to 24 carbon atoms include dodecanoic acid, palmitic acid, stearic acid, oleic acid, ricinoleic acid, 12-hydroxystearic acid. The hydroxy fatty acids, particularly hydroxystearic acid, are preferred since they provide greater thickening to the greases than the unsubstituted fatty acids.

Converting agents useful in this invention include, among many others, water; alcohols, for instance, methanol, isobutanol, n-pentanol and many others or mixtures thereof or mixtures of alcohols with water; alkylene glycols; mono-lower alkyl ethers of alkylene glycols such as monomethylether of ethylene glycol (methyl Cellosolve); and numerous others such as lower aliphatic carboxylic acids exemplified by acetic acid and propionic acid; ketones; aldehydes; amines; phosphorus acids; alkyl and aromatic amines; certain imidazoilines; alkanolamines; boron acids, including boric acid; tetraboric acid; metaboric acid; and esters of such boron acids; and, also, carbon dioxide as such, or better in combination with water.

From 20 to 100% of the soap forming $C_{12}$ to $C_{24}$ fatty acid can be employed in the converting step with the remainder added to the converted grease. When all of the soap forming fatty acid is used in the converting step, grade 2 greases can be produced containing about 32% by weight overbased calcium sulfonate. As pointed out in commonly assigned Case No. 115 P 001, filed on even date, other things being equal, splitting the fatty acid in this way permits the production of grade 2 greases containing 15 to 28% by weight overbased calcium sulfonate. Accordingly, if all the fatty acid is used in the conversion step more overbased calcium sulfonate is necessary to produce a grade 2 grease.

As has been indicated above, the high performance calcium borate modified overbased calcium sulfonate/-calcium carbonate complex greases of our invention comprise overbased calcium sulfonate, oleaginous vehicle, calcium carbonate in the calcite form, minor proportions, by weight, of (a) a calcium borate and (b) a calcium soap of a soap-forming aliphatic monocarboxylic acid containing at least 12 carbon atoms, said (a) and (b) ingredients being essentially homogeneously distributed through said complex grease, and in which the preferred embodiments utilize as the calcium soap the calcium soaps of hydroxy $C_{12}$–$C_{24}$ fatty acids, particularly 12-hydroxystearic acid, and in which the (a) ingredient is particularly advantageously formed in situ in said greases and at least a portion of the (b) component is used as a converting agent in the conversion of amorphous calcium carbonate to crystalline calcium carbonate in the form of calcite.

The overbased calcium sulfonate content of said greases, as produced by the processes described above and which are shown by the illustrative particular Examples which are set out below, generally fall within the weight range of about 15 to 35%. The non-volatile oil, particularly a mineral or lubricating oil, content of the greases generally fall within the range of about 60 to about 90%, said proportions of said non-volatile oil constituting the total oil, that is, the added non-volatile oil plus that present in the overbased calcium sulfonate composition. The boron acid or boric acid component, in the greases of our invention, generally fall within the range of about 0.6 to about 3.5% with a particularly preferred range of about 1.2 to about 3%. The content of the soap-forming, aliphatic monocarboxylic acid, such as 12-hydroxystearic acid, used in the production of the calcium soap or soaps of the soap-forming aliphatic monocarboxylic acids or hydroxy-fatty acids containing at least 12 and up to about 24 carbon atoms, desirably $C_{12}$ to $C_{18}$ hydroxy-fatty acids, such as commercial hydroxystearic acid, generally fall within the range of about 1 to about 6%, with a particularly preferred range of about 1.3 to about 5%. The added lime or calcium hydroxide, to form the calcium borate and the calcium soaps of the soap-forming aliphatic monocarboxylic acids, is, by weight of the greases, in the range of about 0.5% to about 5%. However, in certain cases, in the preparation of the overbased calcium sulfonate composition or solutions, there is commonly present in said compositions or solutions, after the carbonation step, free dispersed lime or calcium hydroxide in an amount of the order of about 1% to about 1.5%, which may render it unnecessary to add any additional calcium oxide or hydrated lime to form the calcium borate and the calcium soaps of the soap-forming aliphatic monocarboxylic acids, in which event the range of the lime or calcium hydroxide is, by weight of the greases, from 0% to about 5%. The content of calcium borate or its complex reaction mixture in the grease compositions of the present invention is generally in the range of about 1.1% to about 6.7%; and that of the calcium soaps of the aliphatic monocarboxylic or fatty acids in the range of about 1.1% to about 6.5%. The relationship of the proportions of the boric acid, the lime or calcium hydroxide and the soap-forming aliphatic monocarboxylic acids utilized in the production of the greases of our present invention play a definite role in the production of optimum quality or effective greases, as illustrated hereafter. All of the foregoing percentages are in terms of wt.%, based on the weight of the greases as they are produced in accordance with the process or processes of our invention.

Various supplemental ingredients are commonly, incorporated into the greases of our invention, in very distinctly minor proportions but they are not essential to our invention and no patentable novelty is claimed in their use in those instances where they are included in our greases. Illustrative of such supplemental ingredients are oxidation inhibitors such as phenyl alpha naphthylamine (PAN); viscosity index improvers, which may comprise certain polymers (Acryloid 155-C); and others for particular and generally known properties in greases or grease compositions.

The grease compositions of this invention can be prepared by either a one step or two step process in a manner similar to that described in U.S. Pat. No. 4,560,489, which is hereby incorporated by reference.

The two step process comprises heating a Newtonian composition comprising overbased calcium sulfonate, amorphous calcium carbonate, an oleaginous vehicle and a converting agent comprising a fatty acid of 12 to 24 carbon atoms under condition favoring the formation of calcium carbonate crystals in the form of calcite crystals and not raterite crystals. Vaterite crystals should be avoided. On the one hand the calcite crystal form introduces Non Newtonian Rheology, enhances yield and adds to the high temperature properties of the grease while the raterite form is much less thixotropic and does not enhance high temperature grease properties. Accordingly the conversion is carried out at about 80 to 300° F., preferably 145 to 285° F. and up to 85 psi or higher. Then, there is subsequently added thereto, at elevated temperatures, a boric acid compound admixed with or dissolved or partially dissolved in hot water, lime or calcium hydroxide, and any soap-forming aliphatic monocarboxylic or fatty acid, such as a $C_{12}$–$C_{24}$ hydroxy fatty acid, not used in the conversion step to convert the boric acid to a calcium borate and to convert the aforesaid soap-forming acid or acids to calcium soaps, with or without supplemental ingredients which are optional and do not form any part of what represents the essentials of our invention.

In a 1-step procedure for producing the grease compositions of our invention, there would be involved, for instance, broadly stated, preparing a single mixture of a highly overbased non-Newtonian calcium sulfonate solution in a mineral oil or the like then charging to this lime or calcium hydroxide, and a boric acid solution, any soap-forming aliphatic monocarboxylic or fatty acid not used in the conversion step with or without supplemental ingredients, and thoroughly agitating the mixture. It will be understood that, in the 1-step procedure for producing the grease compositions of the present invention, for instance, where a mineral oil or like solution of a sulfonic acid or of a neutral calcium sulfonate is overbased and converted in essentially 1-step to produce a non-Newtonian overbased calcium sulfonate solution, which is further reacted with lime, boric acid and higher molecular weight monocarboxylic or fatty acid, e.g., 12-hydroxystearic acid, there is no intermediate isolation of overbased solution.

The final high performance multipurpose calcium complex thixotropic grease or grease composition of this invention can be defined broadly as a product formed by a combination of (1) a highly overbased calcium sulfonate of a high molecular weight oil-soluble sulfonic acid, dissolved in an oil, particularly a mineral oil, containing extremely finely divided (at least mainly in excess of about 20 A, and, more particularly, in various particle sizes in the range of about 50 or about 100 up to about 1000 A, or even up to about 5,000 A,) calcium carbonate mainly or essentially in the form of calcite; (2) a product formed by the reaction of boric acid with a calcium compound such as, e.g., calcium hydroxide or calcium carbonate (as calcite), presumably calcium borate or calcium borate intermingled or in some kind of complex in the grease or grease composition as a whole; and (3) a product formed from calcium hydroxide/calcium carbonate (as calcite) and a soap-forming aliphatic monocarboxylic or fatty acid, particularly a soap-forming hydroxy-fatty acid, such as 12 hydroxystearic acid, wherein the calcite particles are formed in the presence of a soap forming fatty acid.

As indicated above, cone penetration is determined by ASTM test (D217). More specifically, unworked penetration is measured when a sample of grease is brought to 77° F. (25° C.) and transferred to a standard cup; its surface is smoothed and the cone, in its penetrometer assembly placed so that its tip just touches the level grease surface. The cone and its movable assembly, weighing 150 G (0.33 pound), are permitted to rest on and drop into the grease for exactly five seconds. The distance dropped is measured.

Many greases change significantly in consistency when manipulated. A worked penetration is thus considered more significant as to service behavior than is unworked penetration. For this test, the grease is churned 60 round-trip strokes in a standard worker, again at 77° F. (25° C.). Air is driven out of the sample, its surface is smoothed, and again the penetration of the cores is measured.

CLASSIFICATION OF GREASES BY NLGI CONSISTENCY NUMBERS

| NLGI Number | ASTM Worked Penetration |
|---|---|
| 000 | 445–475 |
| 00 | 400–430 |
| 0 | 355–385 |
| 1 | 310–340 |
| 2 | 265–295 |
| 3 | 220–250 |
| 4 | 175–205 |
| 5 | 130–160 |
| 6 | 85–115 |

In the examples that follow, the starting overbased $C_{12}$ to $C_{40}$ alkylbenzene calcium sulfonate was prepared in the manner set forth in U.S. Pat. No. 4,560,489, which is incorporated by reference and analyzed as follows.

| | |
|---|---|
| Total Calcium, wt. % | 15.2 |
| Calcium $C_{12}$ to $C_{40}$ alkylbenzene Sulfonate, wt. % | 18 |
| Alkalinity value (TBN) | 400 |
| Molecular weight | 1020 |
| Specific Gravity @ 60° F. | 1.200 |
| Flash Point C.O.C. °F. | 370 |
| Viscosity SUS @ 210° F. | 300 |
| Color ASTM Dilute | 7 |
| Water, et. % | 0.3 to 0.5 |
| Appearance | Bright |
| $CaCO_3$-(CALC), wt. % | 35 |

-continued

| Metal Ratio | 20 |
|---|---|

EXAMPLE 1

Three hundred eighty grams overbased calcium sulfonate, 73 gram 2000 SUS viscosity oil, 142 grams 500 SUS Viscosity oil, 21.5 grams detergent dodecylbenzene sulfonic acid 31 grams 12-hydroxystearic acid and 38 grams water were heated to about 140–145° F. under stirring in a two liter breaker. Four and one-half grams acetic acid was added slowly followed by 16.7 grams methanol- The reaction was maintained at 150 to 160° F. until thickening and conversion of amorphous calcium carbonate to calcite was complete as determined by infra-red. After 26.4 gram lime in 50 grams water and 23.2 grams boric acid in 50 grams water were added, volatiles were stripped off at 285° F., 4.6 grams of a mixture of phenyl alphanaphthyl added, cooled and adjusted to Grade 2 with about 200 grams Trim-500 viscosity oil. The product weighing 1,180 grams, contained 32.2% starting overbased calcium sulfonate and had a worked penetration between 265 to 295.

COMPARISON EXAMPLE A

Example 1 was repeated except that the hydroxystearic acid was omitted from the calcite forming step and the concentration of oleaginous material adjusted to produce a Grade 2 grease. Three hundred eighty-grams overbased calcium sulfonate, 73 grams 2000 viscosity oil, 21.5 grams detergent dodecylbenzene sulfonic acid and 38 grams water were heated to about 140–145° F. under stirring in a one liter breaker- Four and one-half grams acetic acid was added slowly followed by 16.7 grams methanol. The reaction was maintained at 150 to 160° F. until thickening and conversion of amorphous calcium carbonate to calcite was complete as determined by infra-red. After the composition was transferred to a 2-liter breaker, there was added in sequence 69 grams 2000 SUS viscosity oil, 73 grams 500 SUS viscosity oil, 26.4 grams lime in 50 grams water, 23 grams boric acid, and 31 grams 12-hydroxystearic acid. The reactants were stripped at 280° F., 4.6 grams of phenyl alpha naphthylamine added, cooled and adjusted to Grade 2 with about 250 grams 500 SUS viscosity oil. The product weighing 932 grams, contained 40% starting overbased calcium sulfonate and had a worked penetration between 265 to 295.

Example 1 and comparison Example A demonstrate that higher yields of grease having substantially the same properties can be obtained using lower concentrations of overbased calcium sulfonate, provided long chain fatty acid is present during the conversion of amorphous calcium carbonate to the calcite form.

EXAMPLE 2

This example illustrates the production of a grease using part of the hydroxystearic acid in the calcium carbonate conversion step and post addition of hydroxystearic acid. Three hundred eighty grams overbased calcium sulfonate, 703 grams 500 SUS viscosity oil, 21.5 grams detergent sulfonic acid, 21.5 grams 12 hydroxystearic and 38 grams water were mixed for 10 minutes in a pressure reactor. After addition of 6 grams acetic acid, the reactor was sealed and heated quickly to 250–270° F. developing a pressure of 20 to 25 psi. After 1 hour at 250–270° F. and 20 to 25 psi, thickening and conversion of amorphous calcium carbonate to calcite was complete as determined by infra-red and the reactor was vented and cooled to 200° F. using 250 grams 500 SUS viscosity oil. Eighteen and three-tenths grams additional 12-hydroxystearic acid was added and mixed for 15 minutes, followed by 29 grams lime in 50 grams water and 23 grams boric acid in 50 grams water. The composition was mixed at 280° F., adjusted to Grade 2 with about 200 grams 500 SUS viscosity oil, cooled to below 200° F. and 8.3 grams phenyl alpha naphthylamine added. The product weighing 1,660 grams, contained 22.9% starting overbased calcium sulfonate and had a worked penetration between 265–295.

EXAMPLE 3

Example 2 was substantially repeated except that 31 grams hydroxystearic acid was present during the conversion of amorphous calcium carbonate to the crystalline form and no hydroxystearic acid was post added. The product weighing 1300 grams contained 29% starting overbased calcium sulfonate and a small amount of vaterite with the calcite.

We claim:

1. The process of forming a non-Newtonian oil composition in the form of a grease comprising an overbased calcium sulfonate and solid particles of colloidally dispersed calcium carbonate in the form of calcite which comprises heating overbased calcium sulfonate, amorphous calcium carbonate and a converting agent comprising a fatty acid of twelve to twenty-four carbon atoms in an oleaginous medium.

2. The process of claim 1 herein said fatty acid comprises hydroxystearic acid.

3. The process of claim 2 wherein substantially all of the hydroxystearic acid in the grease is present during the conversion of the amorphous calcium carbonate to calcite.

4. The process of forming a non-Newtonian oil composition in the form of a grease comprising an overbased calcium sulfonate, solid particles of colloidally dispersed calcium carbonate in the form of calcite and calcium borate, which comprises the steps of (1) heating overbased calcium sulfonate, amphorous calcium carbonate and a converting agent comprising a fatty acid of twelve to twenty-four carbon atoms in an oleaginous vehicle under conditions favoring the formation of calcium carbonate crystals in the form of calcite crystals and (2) reacting said product of step 1 with components comprising a boric acid compound to develop the grease like properties.

5. The process of claim 4 wherein said fatty acid comprises hydroxystearic acid.

6. A high performance calcium borate modified overbased calcium sulfonate/calcium carbonate complex grease comprising overbased calcium sulfonate, oleaginous vehicle, calcium carbonate in the calcite form, (a) a calcium borate and (b) a calcium soap of a soap forming aliphatic monocarboxylic acid containing at least twelve carbon atoms, said (a) and (b) ingredients being essentially homogeneously distributed through said complex grease, and at least a portion of the (b) component as a converting agent in the conversion of amorphous calcium carbonate to crystalline calcium carbonate in the form of calcite.

7. The composition of claim 6 wherein said soap-forming aliphatic monocarboxylic acid comprises hydroxystearic acid.

8. A Newtonian composition comprising overbased calcium sulfonate, amorphous calcium carbonate, a fatty acid of twelve to twenty-four carbon atoms in an oleaginous media.

9. The composition of claim 8 wherein said fatty acid comprises hydroxystearic acid.

* * * * *

UNITED STATES PATENT AND TRADEMARK OFFICE

CERTIFICATE OF CORRECTION

PATENT NO. : 5,338,467

DATED : August 16, 1994

INVENTOR(S) : William D. Olson et al.

It is certified that error appears in the above-identified patent and that said Letters Patent is hereby corrected as shown below:

Column 5, line 28 and column 5, line 32, "raterite" should read --vaterite--.

Signed and Sealed this

Third Day of October, 1995

Bruce Lehman

*Attest:*

BRUCE LEHMAN

*Attesting Officer*

*Commissioner of Patents and Trademarks*